US009058754B2

(12) United States Patent
Scheiman

(10) Patent No.: US 9,058,754 B2
(45) Date of Patent: Jun. 16, 2015

(54) PORTABLE PROGRAMMABLE SIGN WITH ADJUSTABLE MOUNTING

(71) Applicant: John Scheiman, Huntsville, AL (US)

(72) Inventor: John Scheiman, Huntsville, AL (US)

( * ) Notice: Subject to any disclaimer, the term of this patent is extended or adjusted under 35 U.S.C. 154(b) by 0 days.

(21) Appl. No.: 14/275,855

(22) Filed: May 12, 2014

(65) Prior Publication Data

US 2014/0338239 A1 Nov. 20, 2014

Related U.S. Application Data

(60) Provisional application No. 61/825,022, filed on May 18, 2013.

(51) Int. Cl.
*G09F 9/30* (2006.01)
*G09F 7/18* (2006.01)

(52) U.S. Cl.
CPC .. *G09F 7/18* (2013.01); *G09F 9/30* (2013.01); *G09F 2007/1843* (2013.01); *G09F 2007/1852* (2013.01)

(58) Field of Classification Search
CPC ..... F16M 11/04; F16M 13/02; F16B 47/00; F16B 47/006; B60R 2011/0056; B60R 11/02; G09F 7/18; G09F 2007/122
USPC ..... 40/618, 661, 649, 597; 248/298.1, 339, 248/340, 295.11, 297.21, 424
See application file for complete search history.

(56) References Cited

U.S. PATENT DOCUMENTS

| | | | | |
|---|---|---|---|---|
| 2,307,752 | A * | 1/1943 | Anderson | 248/683 |
| 4,361,828 | A | 11/1982 | Hose | |
| 4,868,542 | A | 9/1989 | Thompson | |
| 5,574,428 | A | 11/1996 | Groover | |
| 5,905,434 | A | 5/1999 | Steffan | |
| 6,195,000 | B1 | 2/2001 | Smith | |
| 6,553,285 | B1 | 4/2003 | Bahmad | |
| 6,708,433 | B1 * | 3/2004 | Falkner et al. | 40/597 |
| 6,817,123 | B2 | 11/2004 | Okazaki et al. | 40/452 |
| 6,867,692 | B2 | 3/2005 | Weatherspoon | 340/479 |
| 7,099,700 | B2 | 8/2006 | Hwang | |
| 2002/0053154 | A1 * | 5/2002 | Stephan | 40/765 |
| 2002/0067591 | A1 * | 6/2002 | Tajima | 361/681 |
| 2003/0284107 | | 5/2003 | Covey | |
| 2003/0167666 | A1 * | 9/2003 | Close, Jr. | 40/452 |
| 2004/0219951 | A1 | 11/2004 | Holder | |
| 2005/0083183 | A1 | 4/2005 | Cao et al. | 340/426.13 |
| 2005/0105284 | A1 | 5/2005 | Ishizuka | 362/84 |
| 2005/0259434 | A1 | 11/2005 | Pederson | 362/555 |
| 2006/0171148 | A1 | 8/2006 | Huang | 362/249 |
| 2007/0074436 | A1 * | 4/2007 | Steed | 40/661 |
| 2007/0258270 | A1 | 11/2007 | Scheiman | |

* cited by examiner

*Primary Examiner* — Casandra Davis
(74) *Attorney, Agent, or Firm* — James Richards

(57) ABSTRACT

A portable sign having a two axis adjustable mounting requiring no tools for adjustment. The sign may be an electronically programmable flat sign. The mounting may comprise at least one linear slidably adjustable arm configured for varying a position of the arm. The arm may have a suction cup attached thereto by a flexible band wrapping around the arm. The flexible band configured to allow rotation around the arm in a plane perpendicular to the arm. The flexible band having detents molded therein to ensure secure retention of the weight of the sign at any detent stop position. The sign may have a housing with slots running the length of the sign for attaching the arms. The housing may be extruded and may include board mounting and end cap attachment features in the extrusion. The sign may typically include four adjustable arms; however any number may be used.

17 Claims, 11 Drawing Sheets

Fig. 3A
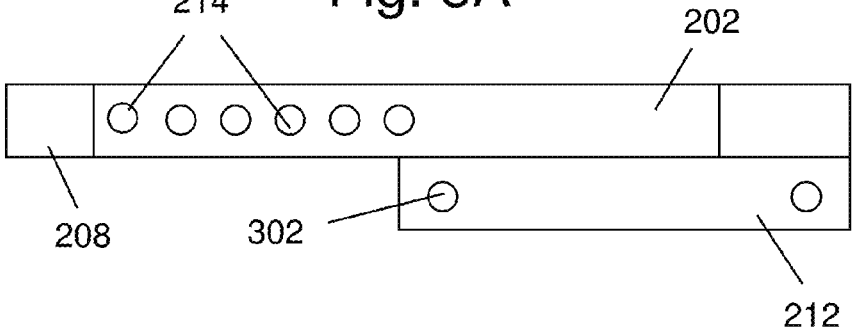
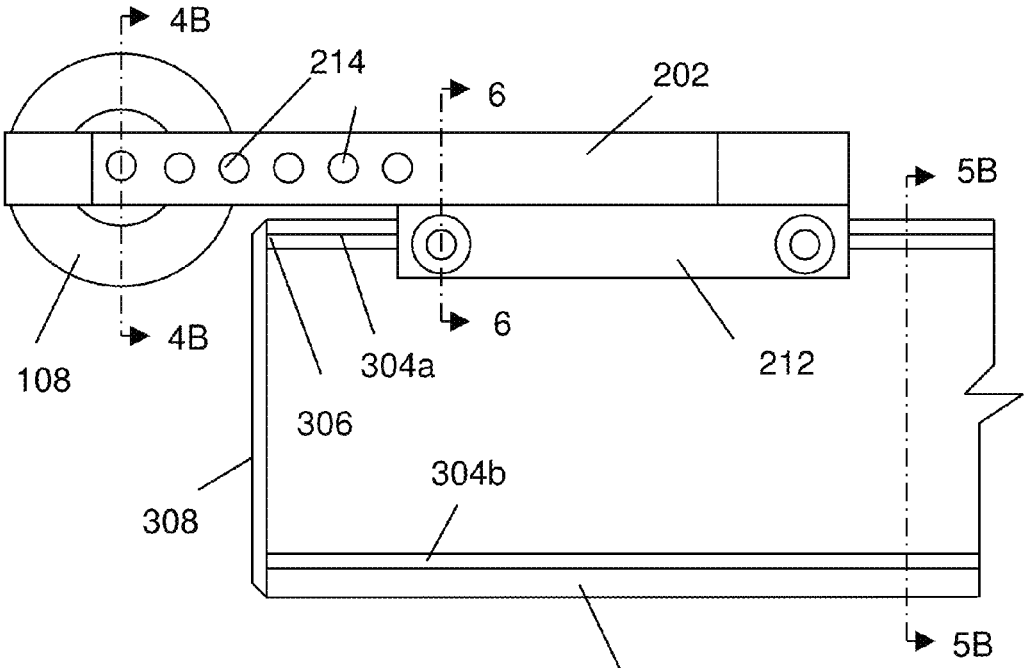
Fig. 3B

Fig. 4A
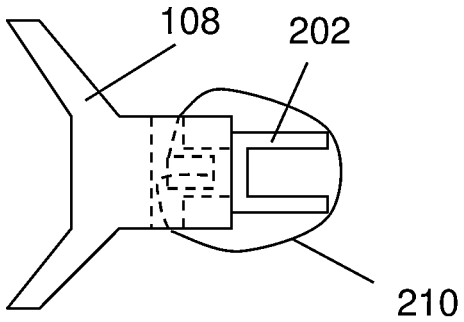
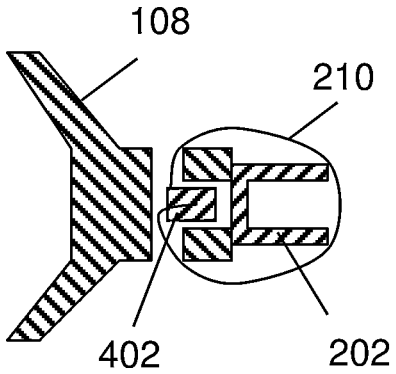
Fig. 4B

Fig. 5A
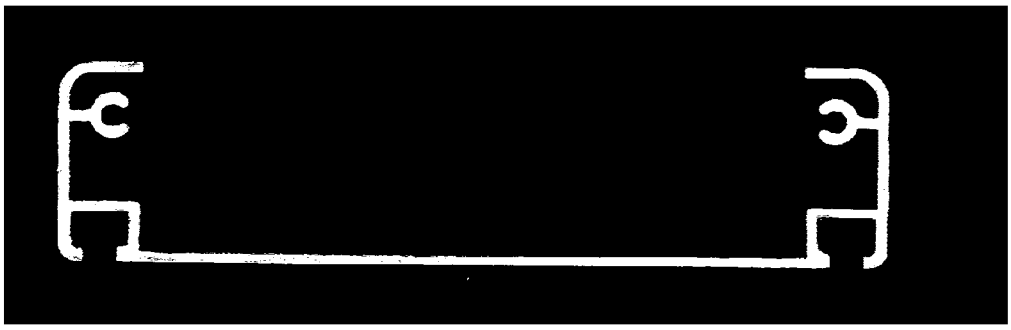
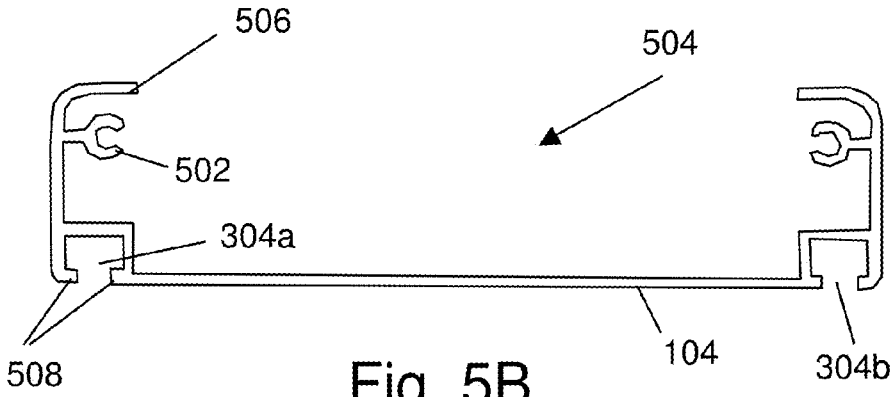
Fig. 5B

Fig. 8A
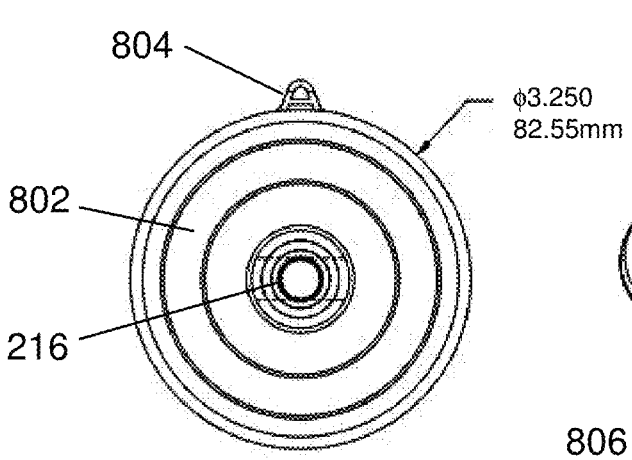
Fig. 8B
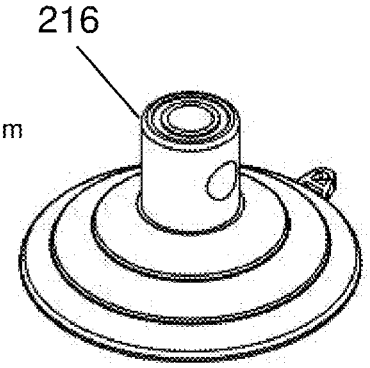
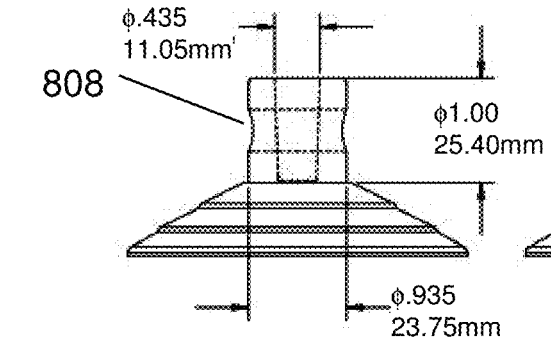
Fig. 8C
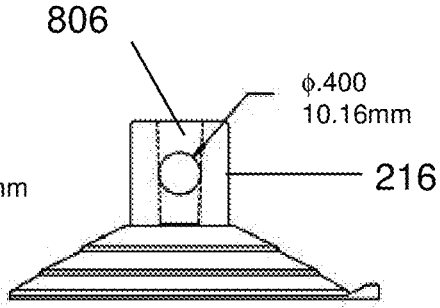
Fig. 8D

PORTABLE PROGRAMMABLE SIGN WITH ADJUSTABLE MOUNTING

RELATED APPLICATIONS

This application is a non-provisional application claiming the benefit under 35 USC 119(e) of provisional application 61/825,022 titled "Portable Programmable Sign with Adjustable Mounting", filed May 18, 2013 by John Scheiman, which is incorporated herein by reference in its entirety.

TECHNICAL FIELD

The present invention pertains generally to the field of signs, more particularly to the construction and mounting structures for portable signs.

BACKGROUND

Portable signs may be provided with attachments that have limited adaptability. Providing multiple different attachments may be costly. Thus, there is a need for a sign with greater attachment adaptability that can be produced at a low cost.

BRIEF DESCRIPTION

Briefly, the present invention pertains to a portable sign having a two axis adjustable mounting requiring no tools for adjustment. The sign may be an electronically programmable flat sign. The mounting may comprise at least one linear slidably adjustable arm configured for varying a position of the arm. The arm may have a suction cup attached thereto by a flexible band wrapping around the arm. The flexible band configured to allow rotation around the arm in a plane perpendicular to the arm. The flexible band having detents molded therein to ensure secure retention of the weight of the sign at any detent stop position. The sign may have a housing with slots running the length of the sign for attaching the arms. The housing may be extruded and may include board mounting and end cap attachment features in the extrusion. The sign may typically include four adjustable arms; however any number may be used.

One variation may include a housing for the sign that includes channels in the back wall of the housing that permit attachment of the arms. The channels allow the arms to be adjusted along the full length of the housing, parallel to the housing. The housing may be fabricated as an extrusion of material, for example aluminum or plastic or other material. The extrusion may include a flange adapted for mounting a circuit board or sign module. The flange may also include a circular slot allowing attachment of an end plate using screws, for example self tapping screws, and allowing insertion of a circuit board for mounting of components in the housing.

In one embodiment, the portable electronic display may comprise: an electronic display module; a housing for said electronic display module, said housing having a cavity for receiving said electronic display module; said electronic display module mounted in said housing and permitting uninterrupted view of a display surface of said electronic display, said housing may comprise: a frame component, said frame component forming at least one linear channel configured for receiving a bolt head for attaching a mounting device to said frame component.

The frame component may include a rib having a slot for mounting a circuit board component of said electronic display module. The frame component may further include a bezel portion on the front of the display to the side of an opening for the electronic display module.

The frame component may form additional channels parallel to said first channel. The frame component may be fabricated as a single unitary component and may be fabricated by extrusion of a material, for example aluminum, aluminum alloy, plastic or other material.

The display may include a mounting component comprising a suction cup arm configured for attachment to the frame component using at least two bolts inserted into a channel. The suction cup may be mounted to the arm on a swivel mount allowing rotation of the suction cup for positioning the suction cup to a surface. The suction cup mounting may comprise a detent mechanism, which may be a flexible band.

The display may include alternate mounting attachment devices, for example a pole mount frame adapted to attach to the slots. The pole mount frame may include a threaded connection for standard poles, for example painter's roller extension handles or mop handles. In one example, the thread may be ⅝ inch 5 thread per inch.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 3A is a rear view of the attachment arm of FIG. 2.

FIG. 3B is a rear view of a sign with the attachment arm of FIG. 3A further including a suction cup.

FIG. 4A and FIG. 4B show two views of an exemplary suction cup and exemplary rotatable mounting for the suction cup of FIG. 3B.

FIG. 5A and FIG. 5B illustrate a cross section of an exemplary extrusion for forming the housing of the display of FIG. 1.

FIG. 8A-FIG. 8D show various views of an exemplary suction cup used with the arm of FIG. 2.

DETAILED DESCRIPTION

The present disclosure teaches a portable electronic sign and mounting system that provides greater adaptability and simplicity than prior techniques. The sign may comprises a housing having an open side on at least one side configured for receiving a sign array, and allowing uninterrupted display of the sign array. Two slotted rails may be provided inside the housing for mounting one or more circuit cards for driving the sign array. At least one and preferably two linear parallel slotted cavities may be formed on the back side of the housing for attaching one or more of various alternative attachment devices suitable for different display applications. The attachment devices may include, but are not limited to a suction cup arm, a general purpose bracket, a threaded pole mounting adapter, and other attachment devices. In one variation, the housing may be formed by extruding aluminum, plastic or other suitable material. The extruded form may include the principle features of the housing in one solid continuous piece. The extrusion may be fabricated and then cut to any length desired. The arrangement allows for an easily adjusted, yet rigid and strong mounting.

Figure 1:
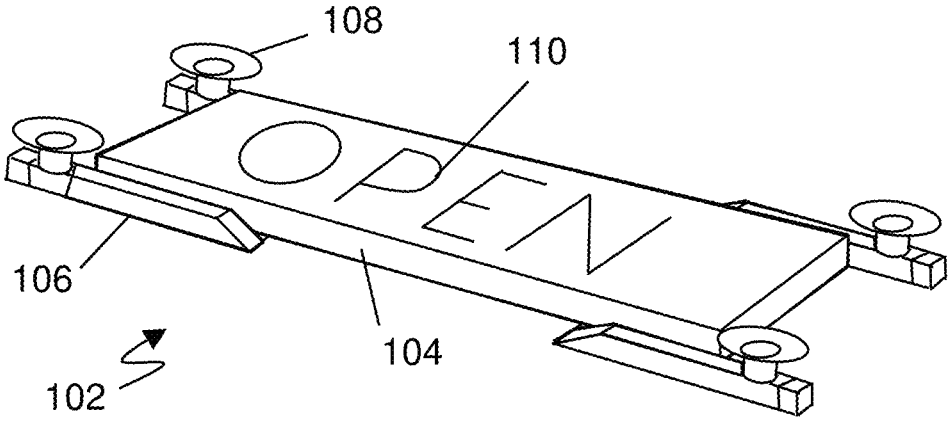
FIG. 1 is a perspective view of an exemplary electronic display with attachment arms.

FIG. 1 is a perspective view of an exemplary electronic display with attachment arms. Referring to FIG. 1, the display assembly 102 (alternatively referred to as a sign) comprises a display module 110 mounted in a display housing 104. Attachment arms 106 are shown connected to the four corners of the display housing. The attachment arms 106 may be connected to the back side of the housing 104 using slots (alternatively referred to as channels) running the length of the housing 104. The slots allow adjustment of the position of the arms 106 along the length of the sign. The arms may have suction cups 108 attached as shown. Other attachment devices may be used. The suction cups 108 are shown facing forward to mount the sign on a glass window so that the sign may be seen through the window. For example, the sign may be mounted on the inside of a store window so that the sign may be visible on the outside of the window, or the sign may be mounted on the inside of the back window of a vehicle to display messages to be read by following traffic. Alternatively, the suction cups may be rotated 180 degrees to mount the sign on the front side of a window or on another surface, which may be opaque.

Four mounting arms 106 are shown; however, two may be sufficient. The sign may be hung from the top two mounting arms and suction cups. For example the sign may hang vertically from a sloping vehicle window by attaching only the top suction cups and rotating the suction cups to match the angle of the vehicle window. The mounting arms may be positioned in the channels toward the middle or center of the sign to accommodate curved vehicle windows.

Figure 2:
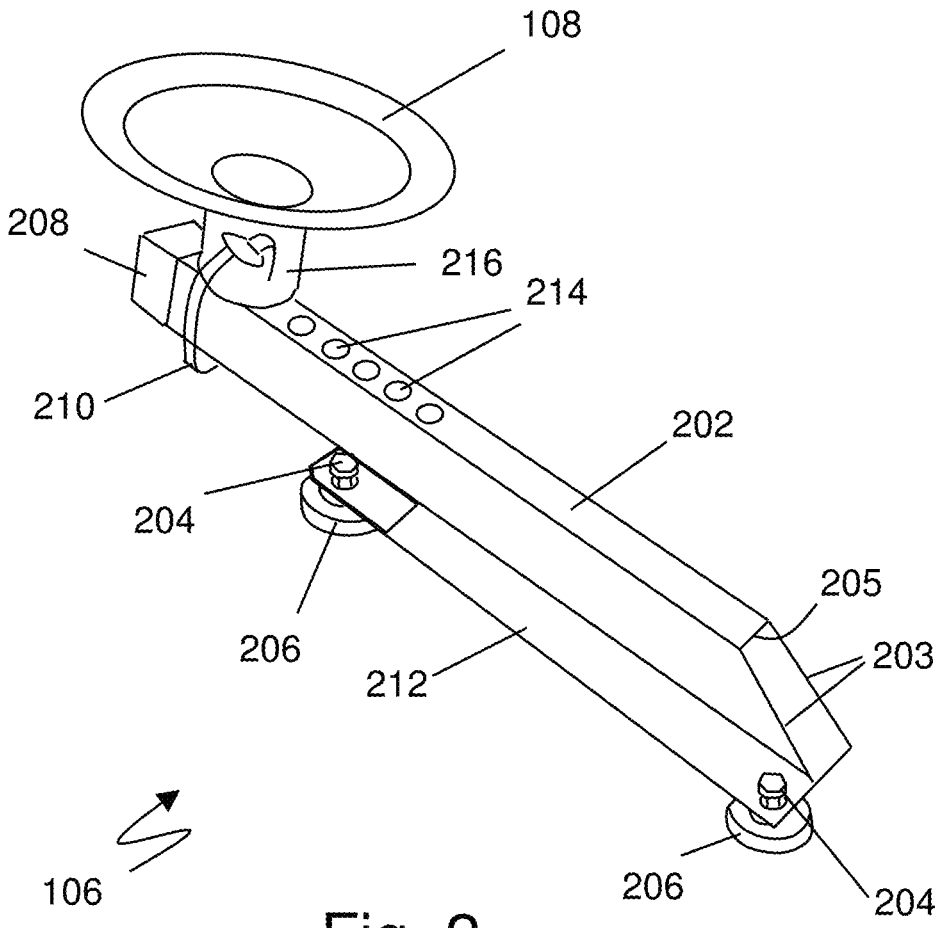
FIG. 2 is a perspective view of an attachment arm for the electronic display of FIG. 1.

FIG. 2 is a perspective view of the attachment arm assembly 106 for the sign of FIG. 1. FIG. 2 shows the attachment arm 202 with a suction cup 108. The attachment arm 202 has a flange 212 for mounting to the display housing 104. The flange 106 is mounted to the display housing 104 using bolts 204 that fit into the channel in the display housing. The bolts 204 have thumb nuts 206 installed for tightening the mounting. Other fasteners may also be used. The suction cup 108 may be attached to the arm by a fixed or adjustable attachment. An exemplary adjustable attachment is shown. The suction cup is attached by a flexible band 210 that wraps through the stem 206 of the suction cup 108 and around the mounting arm 202. In one variation, the flexible band may be a tie-wrap band. The flexible band allows positioning the suction cup at any rotation angle around the arm. Further, the flexible band may include lateral ridges positioned on the inside of the band next to the arm. The ridges may provide a detent action as the suction cup and band are rotated around the arm to provide more secure positioning of the sign. A tie wrap band may also include ridges used for the tie wrap holding mechanism that may also provide friction detents for holding the suction cup at various angles. The tie wrap detents act with the corners of the arm to provide the detent holding action. (A typical tie-wrap device is a plastic band with a ratchet end and ratchet detents along the band that allow shortening and tightening of the band but the ratchet holds against loosening the band. Tie wraps are often used for tying cable bundles.)

The mounting arm may also be provided with a cap 208 to prevent damage from bumping the ends during transport of the sign. The caps 208 may be permanently affixed with epoxy or other adhesive to prevent easy removal and to provide a stop to prevent the suction cup from slipping off the end. In one variation, the end opposite the cap is closed. The closure may be formed from a continuous sheet with the arm by bending joint 205 and optionally welding joints 203. Other combinations of bending and welding among the three joints may be used.

The suction cup 108 may also be mounted by fixed attachment, such as screws or other fasteners. Holes are provided in the arm for fixed attachment fasteners.

In one variation, the arm 202 may be fabricated by cutting and bending a single sheet of metal.

One suction cup 108 is shown on the arm 202, but two or more per arm may be used for greater holding strength.

FIG. 3A is a rear view of the attachment arm of FIG. 2. FIG. 2 shows the arm 202, the flange 212, the end cap 208, fixed attachment mounting holes 214 and slot attachment holes 302.

FIG. 3B is a rear view of a display with the attachment arm of FIG. 3A further including a suction cup. FIG. 3B shows the attachment arm 202 attached to the channel 304*a* and 304*b* in the display housing 104. The housing 104 is shown with two parallel channels 304*a*, 304*b*, one 304*a* on the top and one 304*b* on the bottom of the housing 104. An end cap 308 may be provided to seal the sign from dust and pests. A suction cup 108 is shown attached to the arm 202. The attachment arm may be mounted on the display housing by inserting the heads of the two mounting bolts into the channel slot 304*a* starting at the end 306 of the housing. The arm 202 may then be positioned, and thumb nuts 206 may be installed and tightened in place to hold the arm 202.

Section views are indicated on FIG. 3B.

FIG. 4A and FIG. 4B show two views of an exemplary suction cup and exemplary rotatable mounting for the suction cup of FIG. 3B.

FIG. 4A shows an end view of an exemplary mounting arm showing the arm 202, a suction cup 108, and a flexible band 210.

FIG. 4B shows a cross section of FIG. 3B at the suction cup location. The suction cup 108 is strapped to the mounting arm 202 with the flexible band 210. The band has a clamp portion 402 that is placed inside a cavity within the suction cup stem to rotate the band with the suction cup to allow the detents in the band to hold the suction cup in position for multiple possible positions around the arm.

Figure 4C:
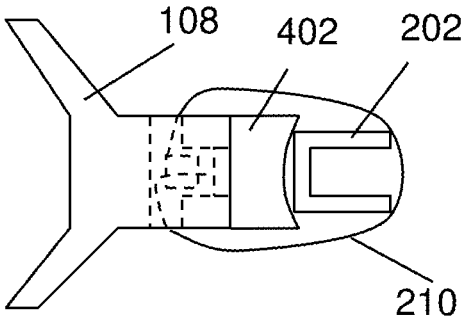
FIG. 4C and FIG. 4D show the configuration of FIG. 4A with an added optional spacer.
Figure 4D:
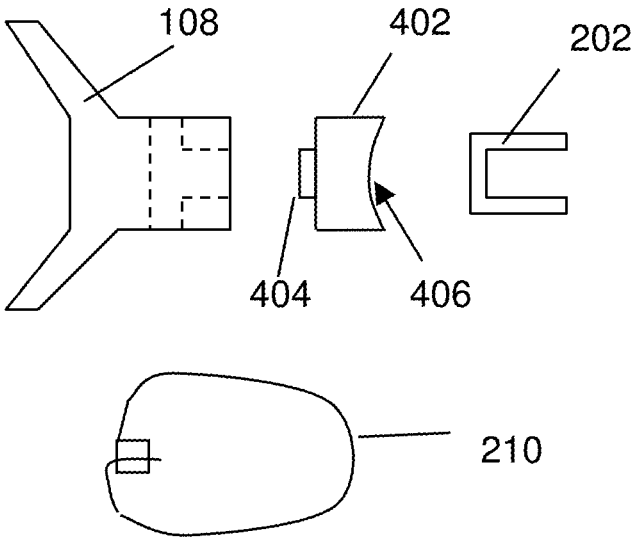

FIG. 4C and FIG. 4D show the configuration of FIG. 4A with an added optional spacer. Spacer 402 may be added to increase the spacing between the sign and the window. The window may have curves, or window frame components, or other features requiring greater space.

FIG. 4D shows an exploded view of FIG. 4C. The spacer includes a boss 404 for fitting into the recess of the suction cup. The spacer may also have a curved end 406 to facilitate rotation around the arm to any selected angle. The suction cup may also have a curved end (not shown). Alternatively, or in addition to the ridges in the flexible band, ridges may be formed into the end of the spacer or suction cup.

FIG. 5A and FIG. 5B illustrate a cross section of an exemplary extrusion for forming the housing of the display of FIG. 1. FIG. 5A is a scan of the cross section. FIG. 5B is a line drawing of FIG. 5A. Referring to FIG. 5A and FIG. 5B, the figures show the housing 104 forming two channel recesses 304*a*, 304*b* for mounting the attachment arm assemblies 106 or other devices. The housing also forms a recess 504 for receiving the display module 110 and may include a slot 502 for receiving and mounting a circuit board. The slot 502 may also be used for receiving screws to attach the end plate 308 (FIG. 3). Slot 502 is shown cut into a circular cross section for preferred interface with screws, which may include self tapping screws; however, a simple rectangular slot may also be used and may also be used with screws. Alternatively, the circuit board may be mounted by other techniques including screws, standoffs, and other devices. Alternatively feature 502 may be a simple flange.

The end plate 308 may allow for inserting the head of screws 204 in the channels 304*a*, 304*b* by not obscuring the end opening of channels 304*a* and 304*b*. The channels 304*a* may be sized to fit the mounting bolt heads 204 with sufficient clearance for easy sliding of the bolt heads but close enough that the bolt heads will not turn in the slots. The slots 304*a* have an opening sized to accommodate the shank and threads of the mounting bolt 204 and flanges 508 for capturing the bolt head. The channel having an internal width to allow passage of the bolt head and preferably to not allow turning of the bolt head.

The housing 104 may further include a bezel portion 506 on the front of the display to the side of the opening for the electronic display module. Thus, the housing forms the front bezel 506, the sides, and the back, and forms the slots 304*a*, 304*b* for the arms and mounting features 502 for circuit boards and end plates.

Figure 6:
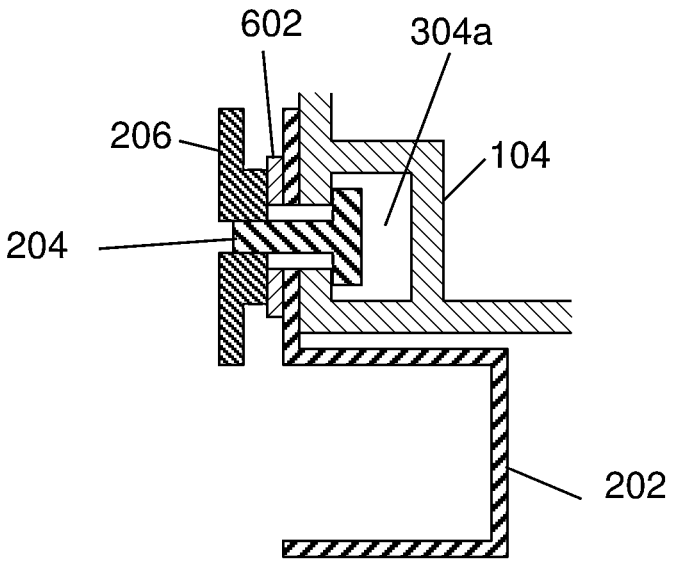
FIG. 6 is a cross section view showing the attachment arm mounted to the channel of the display housing.

FIG. 6 is a cross section view showing the attachment arm mounted to the channel of the display housing. FIG. 6 shows the housing 104, the channel 304*a*, the mounting arm 202, the bolt 204 and thumb nut 206 with washer 602.

Figure 7A:
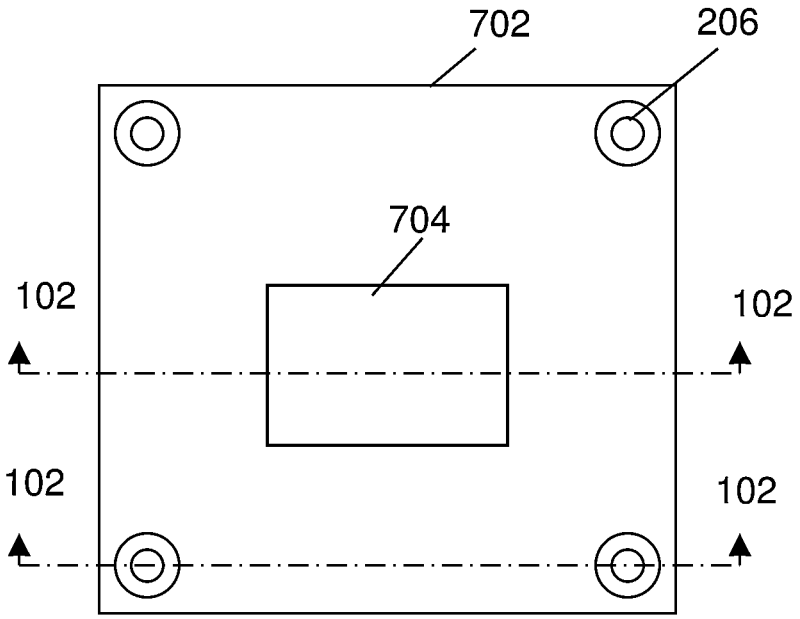
FIG. 7A-FIG. 7C shows an alternative mounting method for the sign that utilizes the channels of the extrusion to mount the display on a pole.

FIG. 7A shows a pole adapter attachment device for mounting the sign on a pole. The pole adapter attachment 700 comprises a plate 702 with a threaded tube 704 mounted thereto. The plate includes four holes with attachment screws and thumb nuts 206 for attaching to the channel structures 304*a*, 304*b* of the housing 104. The threaded tube 704 may include threads for a pole 706, for example, a typical painters extension dowel handle or other tool or mop handle. Painters handles are often threaded with a ⅝ inch 5 thread per inch pitch.

Figure 7B:
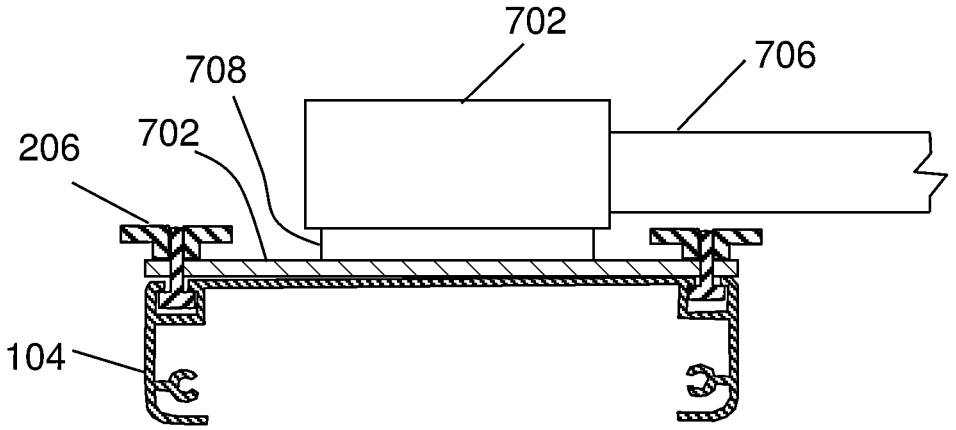

FIG. 7B shows a side view of FIG. 7A at cross section 7B. FIG. 7B also shows the handle 706, the display housing 104 with channels 304*a*, 304*b*, and the mounting bolts with thumb nuts 206. FIG. 7B shows the threaded tube mounted with a stand-off 708.

Figure 7C:
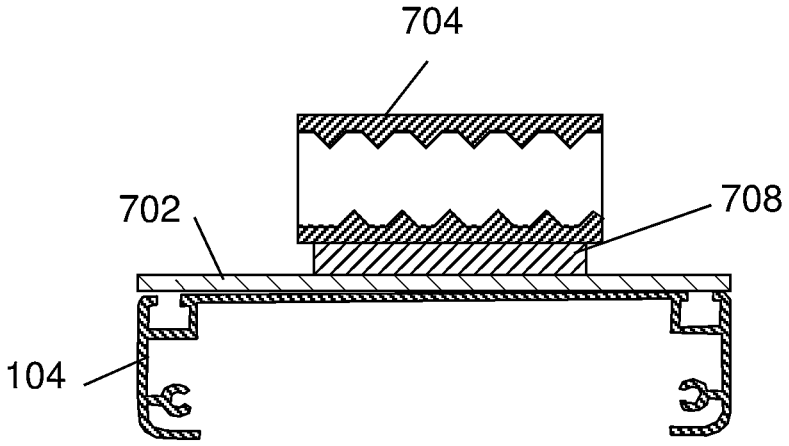

FIG. 7C shows the cross section of FIG. 7A. The threaded tube 704, standoff 708, and plate 702 may be welded, or alternatively may be cast or fabricated as a single piece.

FIG. 8A-FIG. 8D show various views of an exemplary suction cup used with the arm of FIG. 2. FIG. 8A is a top view showing the stem 216 and cup 802 with a lift tab 804. FIG. 8B is an isometric view. FIG. 8C is a side view, and FIG. 8D is a 90 degree side view. Note the recess 806 in the stem 216 and lateral through hole 808 in the stem 216. The recess and lateral through hole may be used to attach the suction cup to the arm.

The suction cups and flexible band should be ultraviolet/sunlight stable for outdoor use. The suction cups may be clear plastic to minimize interference with the view of the sign.

Figures 9A, 9B, 9C:
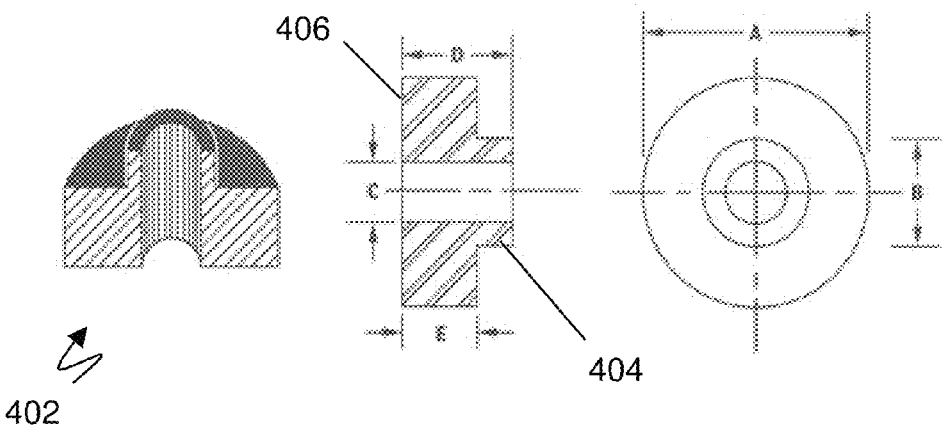
FIG. 9A-FIG. 9C show various views of an exemplary spacer for use with the suction cup.

FIG. 9A-FIG. 9C show various views of an exemplary spacer 404 (alternately referred to as a bushing) for use with the suction cup. FIG. 9A is an isometric cross section view. FIG. 9B is a side cross section view. FIG. 9C is a top view. Exemplary dimensions may be: A=24 mm B=12 mm C=7 mm D=14 mm E=7 mm. Other dimensions may be used as desired for a given application. The spacer 404 is also shown in FIG. 4. FIG. 9 spacer 404 shows a boss for fitting into the suction cup an optional a curved end of the spacer opposite the boss. The spacer of FIG. 9 shows a flat end option for the end opposite the boss. The spacer may be made with a variety of material choices. A soft material, for example, EDPM (ethylene propylene diene monomer), may be used to enhance the staying power for holding in a given position, in particular diagonal positions between the flats of the brackets.

Applications

The sign has numerous applications. The adjustable mounting arms may be used with vehicle windows. As previously described the arms may be adjusted toward the middle for highly curved windows. The top two mountings may be used to hang the sign vertically from a sloping window. The suction cups will rotate to any desired slope to match the window slope.

In a further application, the sign may be used on a store window. The sign may be positioned to be seen outside or inside the window by adjusting the suction cups on the arms. The sign may be used as a real estate sign. The sign may be placed inside a window to provide real estate information such as broker, open house, "under contract", or any other information. The sign can add "bling" to a real estate offering and impress customers with the "high tech" look. In many districts, outdoor real estate signs are problematic or prohibited by code, or impractical due to concrete city setting.

In a further application, the sign may be mounted on a pole, either fixed or hand carried for parades or outdoor events.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the associated claims and their equivalents.

What is claimed is:

1. A portable electronic display system comprising:

an electronic display module having a display surface and a circuit board component;

a housing for said electronic display module, said housing having a cavity for receiving said electronic display module;

said electronic display module mounted in said housing and configured to permit view of said display surface of said electronic display module, said housing comprising:

a frame component, said frame component forming at least one linear channel configured for receiving a bolt head for attaching a mounting component to said frame component;

further including a rib having a slot for mounting said circuit board component of said electronic display module.

2. The portable electronic display as recited in claim 1, wherein said frame component further forms a second channel, said second channel parallel to said first channel.

3. The portable electronic display as recited in claim 2, wherein said frame component is fabricated as a single unitary component.

4. The portable electronic display as recited in claim 3, wherein said frame component is fabricated by extrusion.

5. The portable electronic display as recited in claim 4, wherein said frame component comprises aluminum or an aluminum alloy.

6. The portable electronic display as recited in claim 1, further including said mounting component.

7. The portable electronic display as recited in claim 1, wherein said mounting component comprises a suction cup arm configured for attachment to said frame component using at least two bolts inserted into said first channel; said suction cup arm comprising a suction cup.

8. The portable electronic display as recited in claim 7, wherein said suction cup is mounted to said suction cup arm on a suction cup mounting comprising swivel mount allowing rotation of the suction cup for positioning the suction cup to a surface.

9. The portable electronic display as recited in claim 8, wherein the suction cup mounting comprises a detent mechanism.

10. The portable electronic display as recited in claim 9, wherein the suction cup mounting comprises a flexible band.

11. A portable display system comprising:

a display module comprising a circuit board and a display device mounted on said circuit board, said display device having a display surface parallel to said circuit board;

a housing for said display module, said housing comprising an extrusion, said extrusion forming a recess configured for receiving said display module, said recess having an opening on a front side of said portable display system for exposing said display surface of said display device to view;

said extrusion having at least one slot for receiving said circuit board for mounting said display module in said housing;

said extrusion further having at least one channel configured for receiving at least one mounting bolt for mounting said display module, said channel having an opening opposite said front side of said extrusion;

further including at least one end cap on said extrusion, said end cap affixed to said extrusion by attachments engaging said slot for said circuit board.

12. The portable display system as recited in claim 11, further including a mounting arm attached to said extrusion using said at least one channel.

13. The portable display system as recited in claim 12, wherein said mounting arm further includes a suction cup attached to said mounting arm with a rotatable attachment, said rotatable attachment having friction detents for fixing the rotation of said suction cup.

14. A portable display system comprising:

a display module comprising a circuit board and a display device mounted on said circuit board, said display device having a display surface parallel to said circuit board;

a housing for said display module, said housing comprising an extrusion, said extrusion forming a recess configured for receiving said display module, said recess having an opening on a front side of said portable display system for exposing said display surface of said display device to view;

said extrusion having at least one slot for receiving said circuit board for mounting said display module in said housing;

said extrusion further having at least one channel configured for receiving at least one mounting bolt for mounting said display module, said channel having an opening opposite said front side of said extrusion;

further including a mounting arm attached to said extrusion using said at least one channel;

wherein said mounting arm further includes a suction cup attached to said mounting arm with a rotatable attachment, said rotatable attachment having friction detents for fixing the rotation of said suction cup;

wherein said mounting arm comprises corners, and said rotatable attachment comprises a band having lateral ridges capable of providing said friction detents by acting against said corners of said mounting arm.

15. The portable display system as recited in claim 11, further including a mounting adapter attached to said extrusion using said slot, said mounting adapter having a threaded tube for receiving a threaded pole.

16. A portable display system comprising:

a display module comprising a circuit board and a display device mounted on said circuit board, said display device having a display surface parallel to said circuit board;

a housing for said display module, said housing comprising an extrusion, said extrusion forming a recess configured for receiving said display module, said recess having an opening on a front side of said portable display system for exposing said display surface of said display device to view;

said extrusion including at least one attachment means for receiving said circuit board for mounting said display module in said housing;

said extrusion further having at least one channel means configured for receiving at least one mounting bolt for mounting said display module, said channel having an opening opposite said front side of said extrusion;

further including at least one end cap on said extrusion, said end cap affixed to said extrusion by attachments engaging said at least one attachment means for said circuit board.

17. The portable display system as recited in claim 16, further including a mounting arm attached to said extrusion using said at least one channel means.

* * * * *